US006185974B1

(12) United States Patent
Venturini

(10) Patent No.: US 6,185,974 B1
(45) Date of Patent: Feb. 13, 2001

(54) MACHINE FOR PUNCHING AND BENDING METAL SHEETS

(76) Inventor: Gianfranco Venturini, Via Predicate, 66/E -, I-37044 Cologna Veneta (Verona) (IT)

( * ) Notice: Under 35 U.S.C. 154(b), the term of this patent shall be extended for 0 days.

(21) Appl. No.: 09/347,614

(22) Filed: Jul. 2, 1999

(30) Foreign Application Priority Data

Jul. 21, 1998 (IT) ..... MI98A1668

(51) Int. Cl.[7] ..... B21D 28/00; B21D 5/04

(52) U.S. Cl. ..... 72/294; 72/322; 72/332; 72/420

(58) Field of Search ..... 72/294, 319, 322, 72/326, 332, 335, 311, 420

(56) References Cited

U.S. PATENT DOCUMENTS

| | | | | |
|---|---|---|---|---|
| 4,242,898 | * | 1/1981 | Salvagnini | 72/306 |
| 4,532,794 | | 8/1985 | Mauderer | 72/442 |
| 4,594,868 | * | 6/1986 | Takeuchi | 72/319 |
| 5,187,958 | * | 2/1993 | Prunotto | 72/420 |
| 5,502,993 | * | 4/1996 | Powers | 72/319 |
| 5,528,818 | | 6/1996 | Warneke | 72/203 |
| 5,761,951 | | 6/1998 | Codatto | 72/420 |
| 5,964,119 | * | 10/1999 | Kutschker | 72/420 |
| 5,970,774 | * | 10/1999 | Burgess | 72/294 |

FOREIGN PATENT DOCUMENTS

| | | | |
|---|---|---|---|
| 0 103 885 | | 3/1984 | (EP) . |
| 58-168445 | * | 10/1983 | (JP) ..... 72/420 |
| WO 94/01234 | | 1/1994 | (WO) . |

* cited by examiner

*Primary Examiner*—Daniel C. Crane

(57) ABSTRACT

There is described a machine for machining metal sheets, which comprises a bending machine for bending sides of a metal sheet and a manipulator-rotator that is mobile in relation to the bending machine for automatic positioning of the metal sheet during bending. The machine comprises at least one punching press for punching said metal sheet, that is served by said manipulator-rotator so that said manipulator-rotator is utilised for automatic positioning of the metal sheet both during bending and during punching of the metal sheet.

5 Claims, 11 Drawing Sheets

MACHINE FOR PUNCHING AND BENDING METAL SHEETS

DESCRIPTION

The present invention refers to a machine for machining metal sheets. In particular the invention refers to a machine for punching and bending metal sheets.

Machining of metal sheets requires various distinct operations, in particular punching of the sheets, possibly shearing of the comers, and bending to form a panel having the desired shape.

Currently there are available punching machines, corner shearing machines and bending machines also known as "panelling machines" for bending sheets.

Such machines are distinct from each other. This obviously involves high purchase costs, and slowness of the machining process, since the metal sheets that are not machined yet, or semi-finished or finished ones must be loaded and unloaded from a machine in order to go on to the following machining stage.

In view of the state of the art described, object of the present invention has been to provide a single machine for machining metal sheets, which is capable to carry out the several operations that are currently carried out by different machines.

According to the present invention, such object has been attained by a machine for machining metal sheets, comprising a bending machine for bending sides of a metal sheet and a manipulator-rotator that is mobile in relation to the bending machine for automatic positioning of the metal sheet during bending, characterised in that it comprises at least one punching press for punching said metal sheet that is served by said manipulator-rotator so that said manipulator-rotator is utilised for automatic positioning of the metal sheet both during bending and during punching of the metal sheet.

The present invention provides for a single machine capable to carry out all the operations necessary for machining metal sheets. As compared with the known technique, in which lines of different machines such as punching and bending machines are provided, the machine according to the present invention has a lower cost: all the machining stages are concentrated in a single machine. The machine according to the invention has also a reduced dimension as compared with a line with different machines, and the power consumption is also lower. In addition machining time is also reduced.

The characteristics and the advantages of the present invention will become evident from the following detailed description of an embodiment thereof, that is illustrated as non-limiting example in the enclosed drawings, in which.

Figure 1:
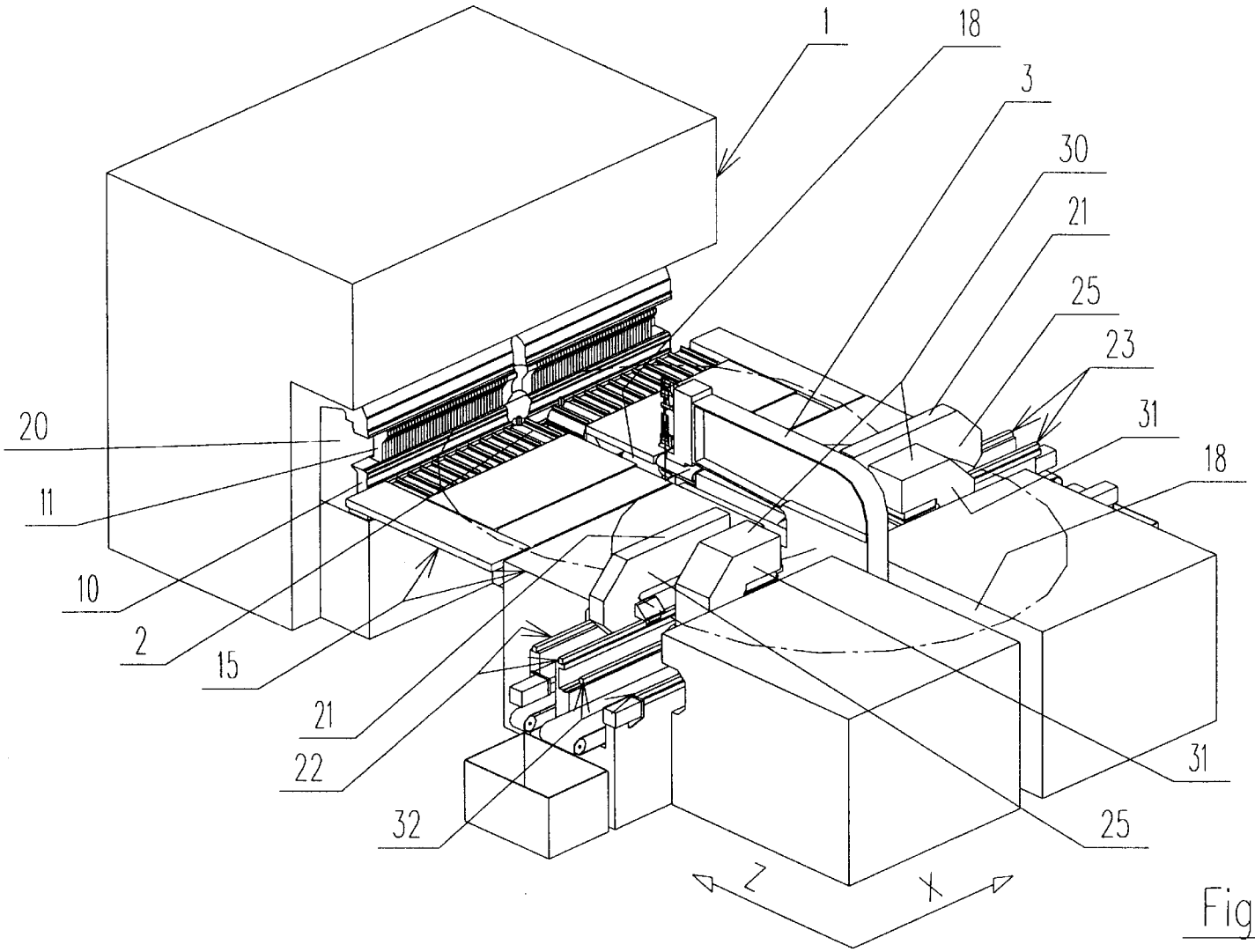
FIG. 1 is a comprehensive axonometric view of a machine according to the present invention.
Figure 2:
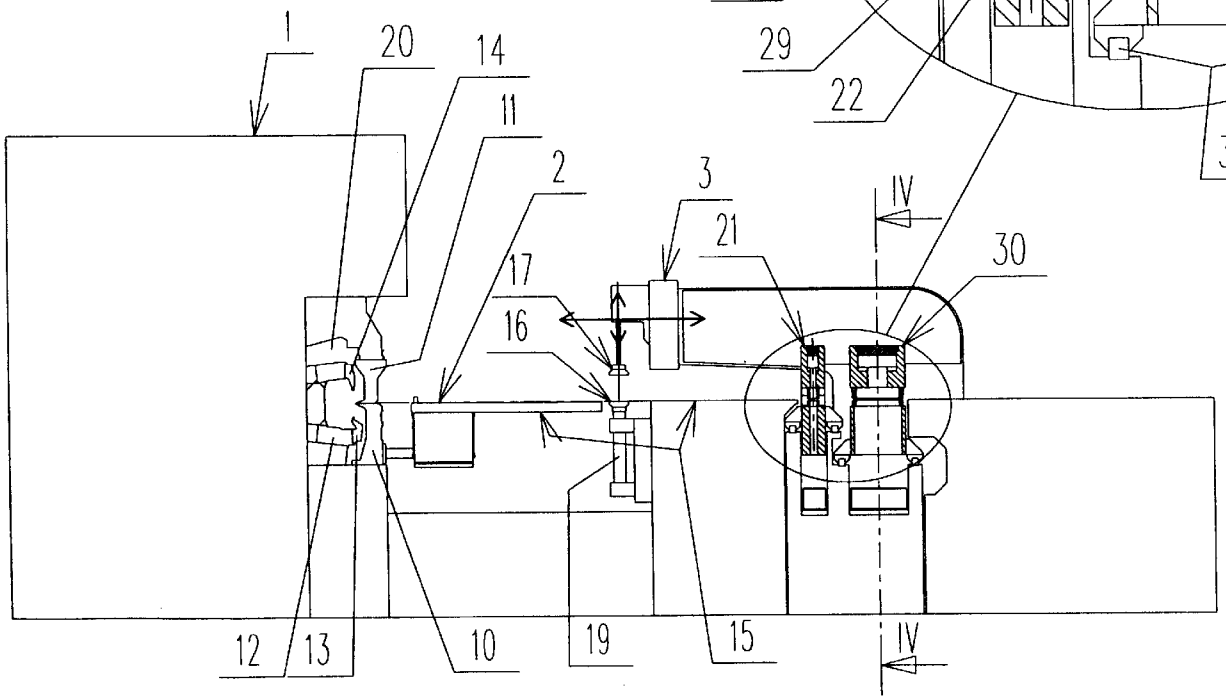
FIG. 2 is a sectional view according to a longitudinal plane of the machine in FIG. 1.
Figures 4, 5:
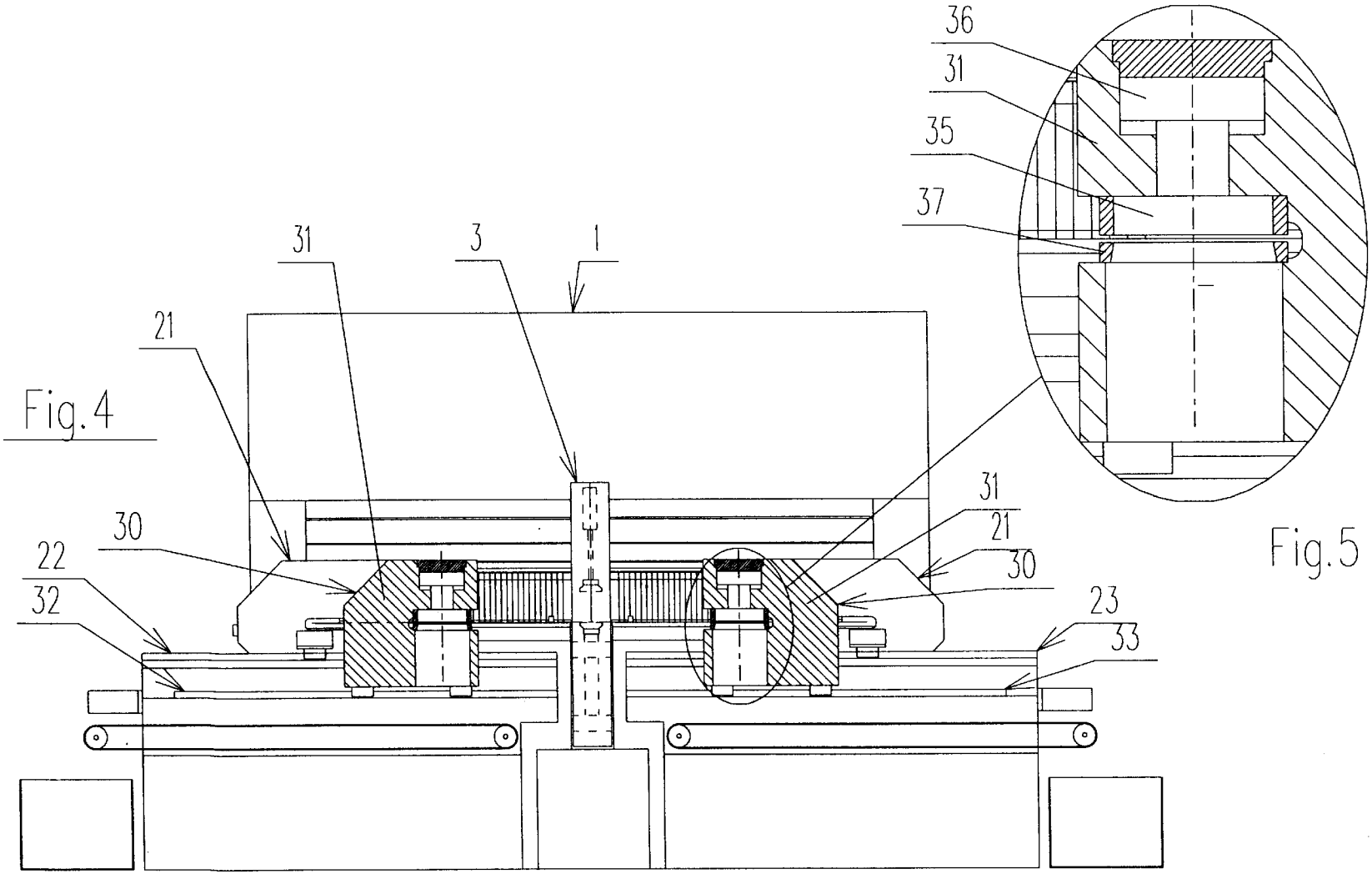
FIG. 4 is a sectional view along, line IV—IV of FIG. 2.
FIG. 5 shows a detail of FIG. 4 in a magnified scale.

With reference to the drawings, in particular to FIGS. 1, 2 and 4, a machine for machining metal sheets comprises a bending or "panelling" machine 1, known per se, which has a front access opening 20 and comprises at such opening a lower row 10 of so-called bending counter-blades, an upper row 11 of blank holder blades, the blank holder blades 11 being mobile so that they cooperate in a known way with the bending counter-blades 10 in order to keep tight an edge of a metal sheet (not shown in these first figures), and, inside the opening 20, a mobile blade holder block 12 that has at its ends lower bending blades 13 and upper bending blades 14.

Before the opening 20 of the panelling machine a work table 15 is located. In a known way, near the opening 20 of the panelling machine the work table 15 comprises a table 2 for correct positioning of the metal sheets to be subjected to bending and for unloading of the bent panels at the end of machining.

The work table 15 is divided into two parts, that are distanced so as to centrally define a rectilinear path 18 for the movement of a manipulator rotator carriage 3, also known per se. The manipulator-rotator carriage 3 comprises a substantially "⊃" shaped structure, with concavity toward the panelling machine 1, as visible in FIG. 2. At the two ends of the "⊃" shaped structure a pair of jaws 16, 17 is mounted, of which the lower jaw 16 is fixed in height, but can rotate as being connected with a shaft 19 that is operated in turn by a motor not shown; the upper jaw 17 is instead idle to rotation, but it is vertically slidable still by action of an opportune drive, for example a hydraulic or pneumatic cylinder not shown. The pair of jaws 16, 17, including the controls for the lifting/lowering of the jaw 17 and for the rotation of the jaw 16, makes up the rotator. The upperjaw 17 can descend toward the lower jaw in order to hold the metal sheet to be machined, and therefore the rotation of the lowerjaw 16, which drags the upper idle jaw 17, allows to rotate the metal sheet on the work table 15.

Figure 3:
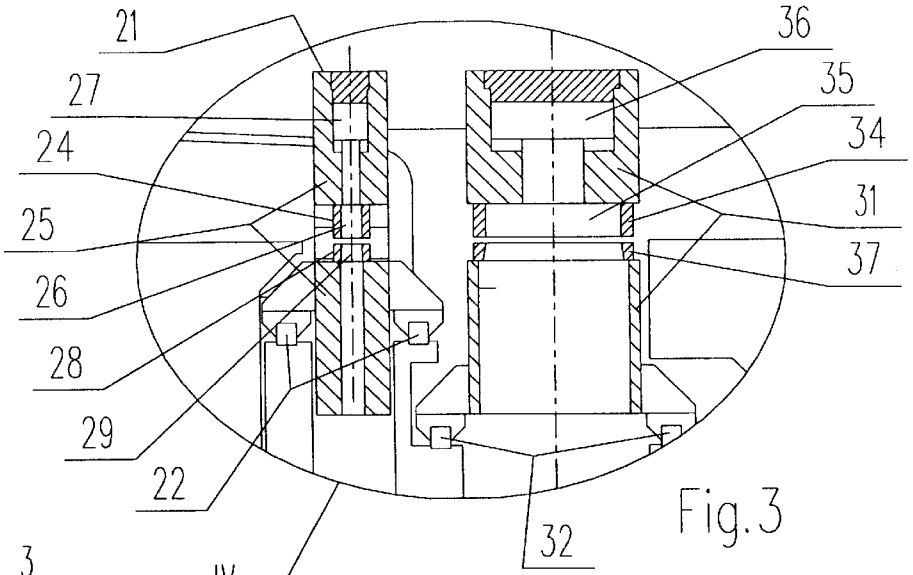
FIG. 3 shows a detail of FIG. 2 in a magnified scale.

Along the work table 15, at a first distance from the panelling machine 1, a first punching press 21 is arranged transversally to the direction of the movement of the manipulator 3. The press 21 comprises two C-shape facing half portals 25, with concavities toward the inside of the work table 15 and whose throats are substantially at the level of the work table 15. The two C-shape half portals are transversally mobile with reference to the direction of movement of the manipulator carriage 3 on two respective pairs of guides 22, 23 by means of a respective system of motion transmission, not visible in the drawings. As it can be seen in the detail of FIG. 3 at the free upper end of each C-shape half portal a punch holder block 24 is mounted, inside which punching tools 26 are located, each being independently controlled from the rest by means of a respective hydraulic or pneumatic cylinder 27. At the free lower end of each C-shape half portal instead a matrix holder block 28 is mounted inside which respective matrixes 29 are housed for the punching tools 26 that are vertically aligned with the same. The punching press 21 is therefore of the commonly called "multi-press" or "multi-punch" type, since it is provided with more punching heads that can work independently from the other ones. However this is not a limitation of the present invention, in that the press 21 could also be of another type, for example of the so-called "mono-press" or "mono-punch" type.

Downstream of the first punching press 21 in the direction of movement from the panelling machine 1, at a second distance from the latter, a second punching press 30 is provided, that is also arranged transversally to the direction of the movement of the manipulator 3. The second press too, as the first press 21, comprises a pair of C-shape facing half portals 31, with concavities toward the inside of the press 21 and whose throats are substantially at the level of the latter.

The two C-shape half portals 31 are transversally mobile with reference to the direction of movement of the manipulator 3 along two respective pairs of guides 32, 33. As it can be seen in FIGS. 3, 4 and 5, at the free upper end of each C-shape half portal 31 a punch holder block 34 is mounted, inside which a single punching tool 35 is housed, that is controlled by means of a respective hydraulic or pneumatic cylinder 36. At the free lower end of each C-shape half portal 31 a matrix holder block 37 is mounted inside which a respective matrix die is located that is vertically aligned with the respective punching head. The second punching press is therefore of the commonly so-called "mono-press" or "mono-punch" type. However, this should not be intended as a limitation of the present invention, in that the second press, as also the first one, could be indifferently of the mono or multi-punch type, according to the type of machining that must be carried out on the metal sheets. Another characteristics of the machine shown in the drawings that must not be interpreted in a limiting way for the present invention is the number of punching presses that are arranged along the work table 15, that could be only one, or else more than two.

It should be noted that even though the two punching presses 21 and 30 shown in the drawings each comprise two C-shape half portals, this does not represent a limitation for the present invention: both punching presses, or only one of them, could comprise a single C-shape half portal, indifferently placed on one side or the other of the manipulator-rotator carriage 3, even if this solution requires more operations of movement of the metal sheet for the complete machining of the same. FIGS. 6 to 13 illustrate, with more schematic plan views of the machine than the previous ones, a possible complete machining cycle of a metal sheet.

Figure 6:
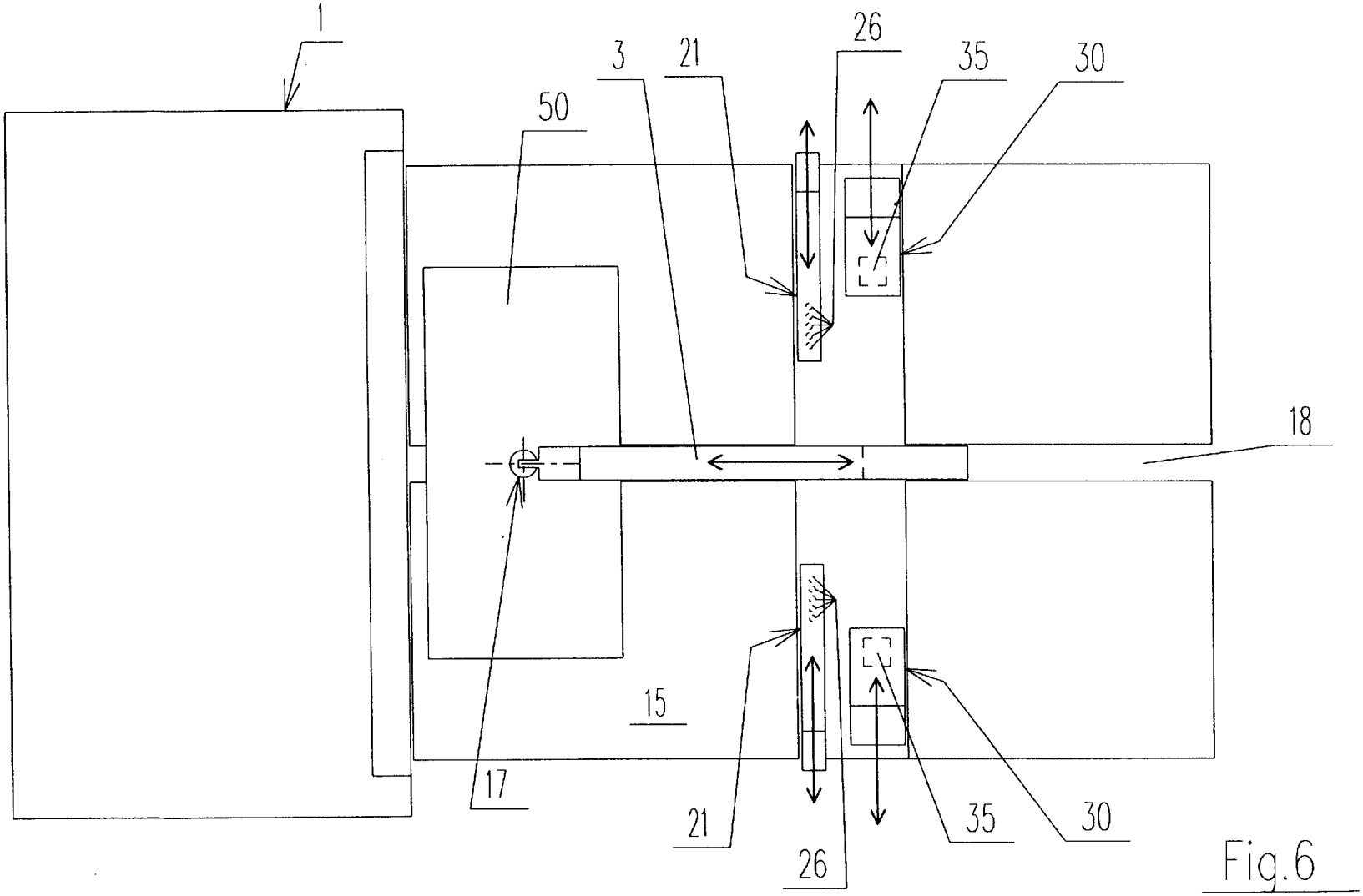
FIGS. 6 to 13 show the machine of FIG. 1 in plan, in a sequence of machining stages of a metal sheet.

In particular, in FIG. 6 there is shown a first stage of a possible machining cycle, consisting in feeding of a metal sheet 50, having generically rectangular shape, on the work table 15.

Feeding can be done manually or, as more commonly, automatically, by means of known feed systems. After having laid the sheet 50 on the work table 15 and having properly positioned it, the manipulator-rotator carriage 3 moves toward the panelling machine 1 until the two jaws 16, 17 get substantially on the vertical line of the centre of the sheet 50. Then, the upperjaw 17 comes down and together with the jaw 16 holds the sheet 50 tight.

Figure 7:
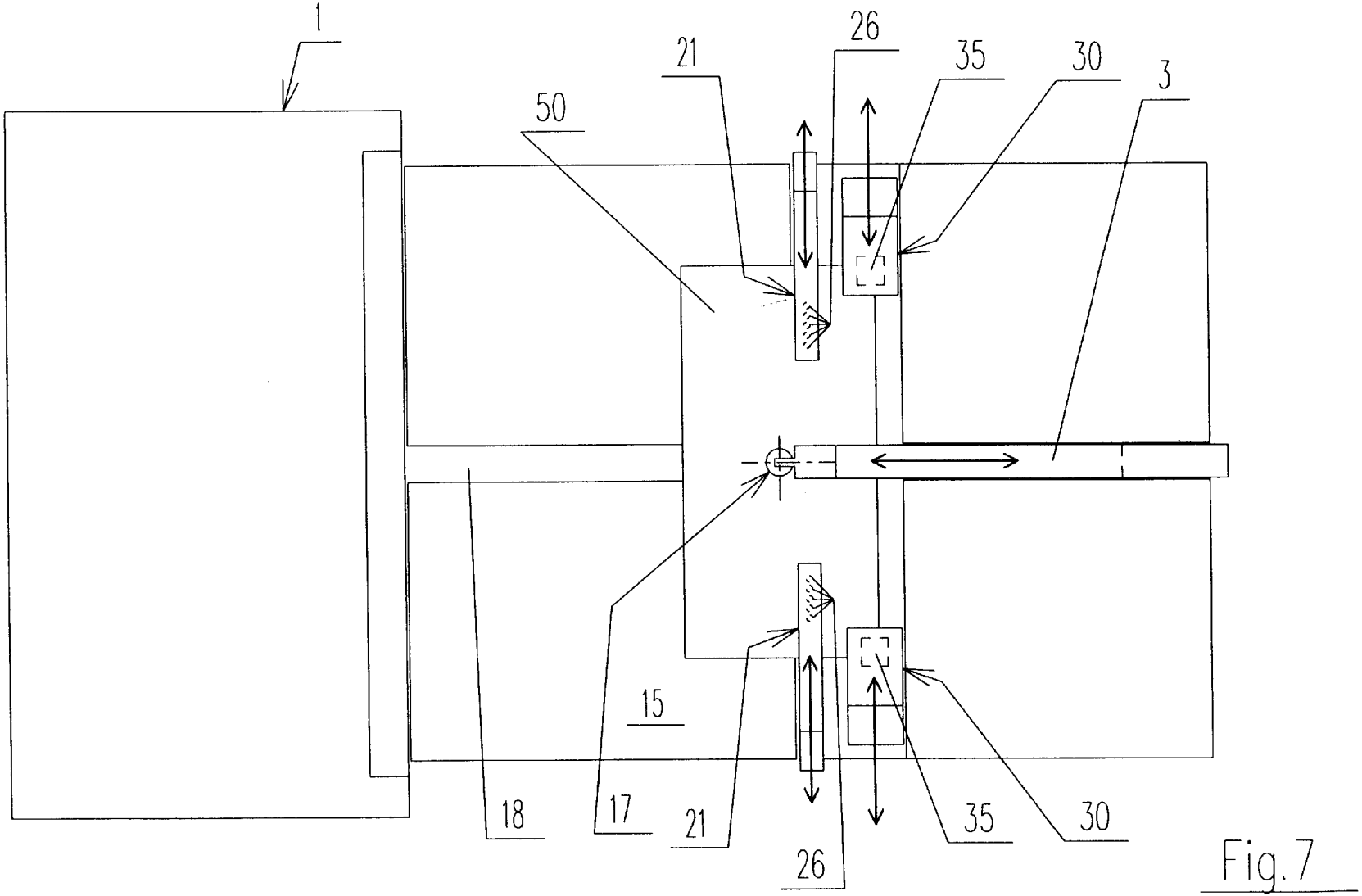

As shown in FIG. 7, the manipulator-rotator carriage 3 therefore gets back toward the two punching presses 21 and 30. If for example the metal sheet 50 must be corner sheared, the carriage 3 moves back until the two back corners of the sheet are brought in correspondence of the second press 30; the latter, by means of cross sliding of the two half portals 31, brings the free ends of the two half portals 31 above the corners of the sheet to be sheared, so that the two punches 34 can simultaneously proceed with the shearing of the two back corners. At the same time, the two half portals 25 of the first press 21 slide transversally in order to bring their free ends with the punch holder blocks in the desired position for the sheet, and therefore to go on with the punching where required.

Figure 8:
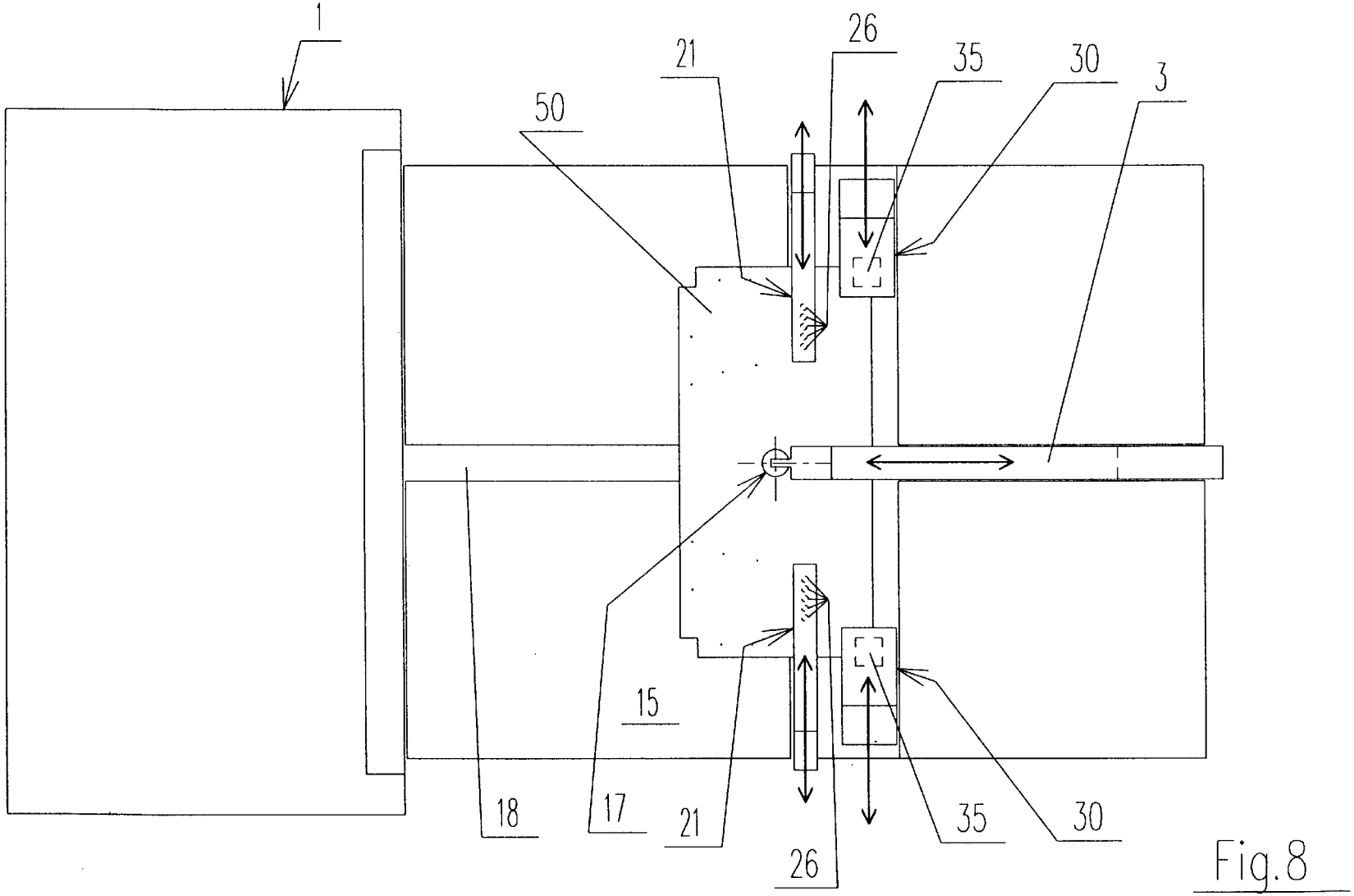

Therefore, as shown in FIG. 8, the sheet 50 is rotated by 180° by means of the rotator (jaws 16, 17 and operation of the lower jaw 16), so that now under the two punching presses 21, 30 there is the other half of the sheet 50 and that it is possible to proceed with the shearing of the two remaining comers, and to the punching of the second half of the sheet where required.

Figure 9:
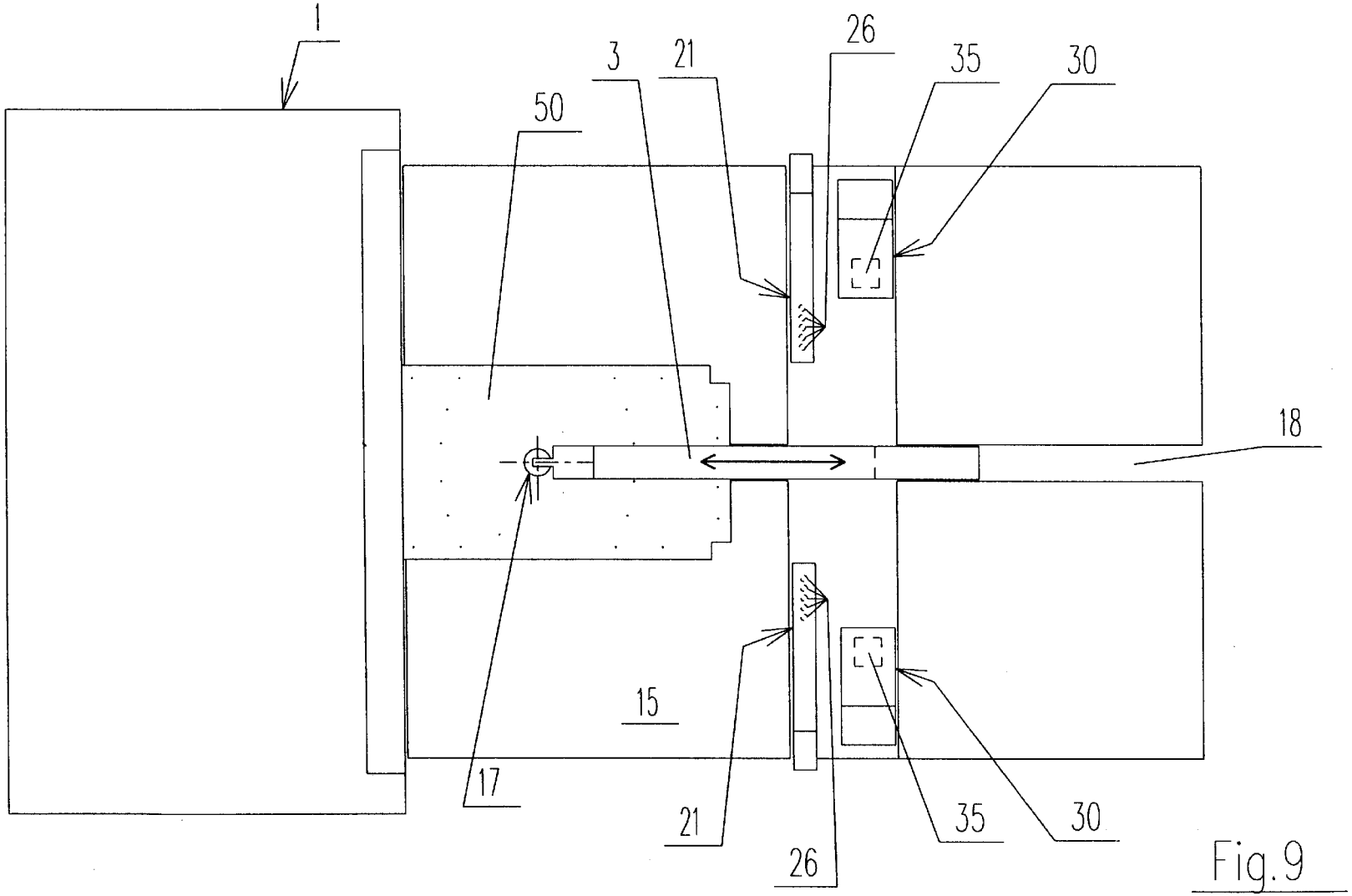

At the end of the corner shearing and punching operations, as shown in FIG. 9 the rotator causes a rotation of the sheet 50 by 90° and then it moves toward the panelling machine 1 in order to bring a first side of the sheet 50, to undergo bending inside the panelling machine 1.

Figure 10:
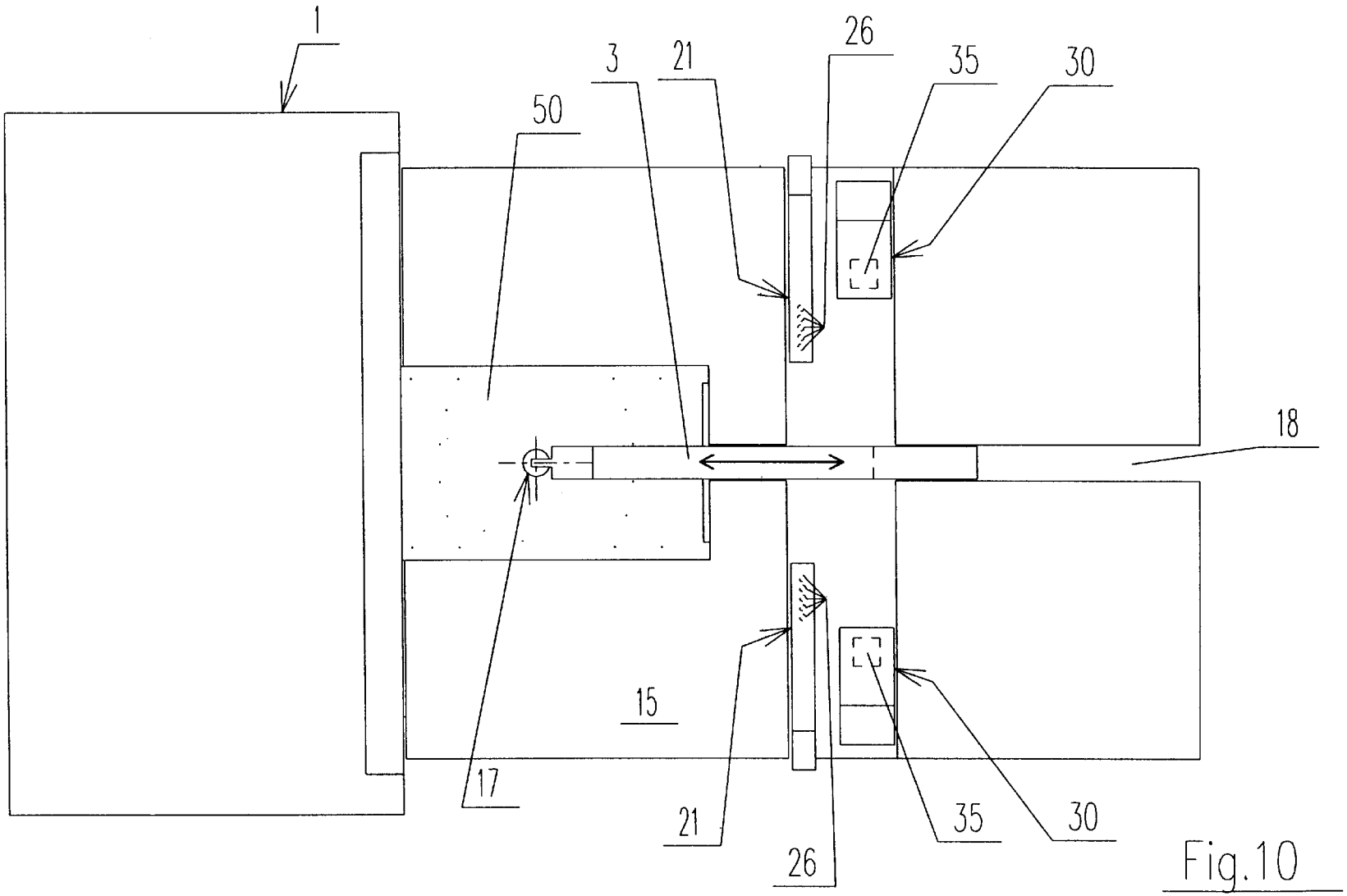

Once the first side of the sheet is bent, the manipulator moves back in order to extract the sheet from the panelling machine, therefore it rotates by 180° and it moves forward again, in order to brine a second side of the sheet 50, opposite to the first one inside the panelling machine, as shown in FIG. 10.

Figure 11:
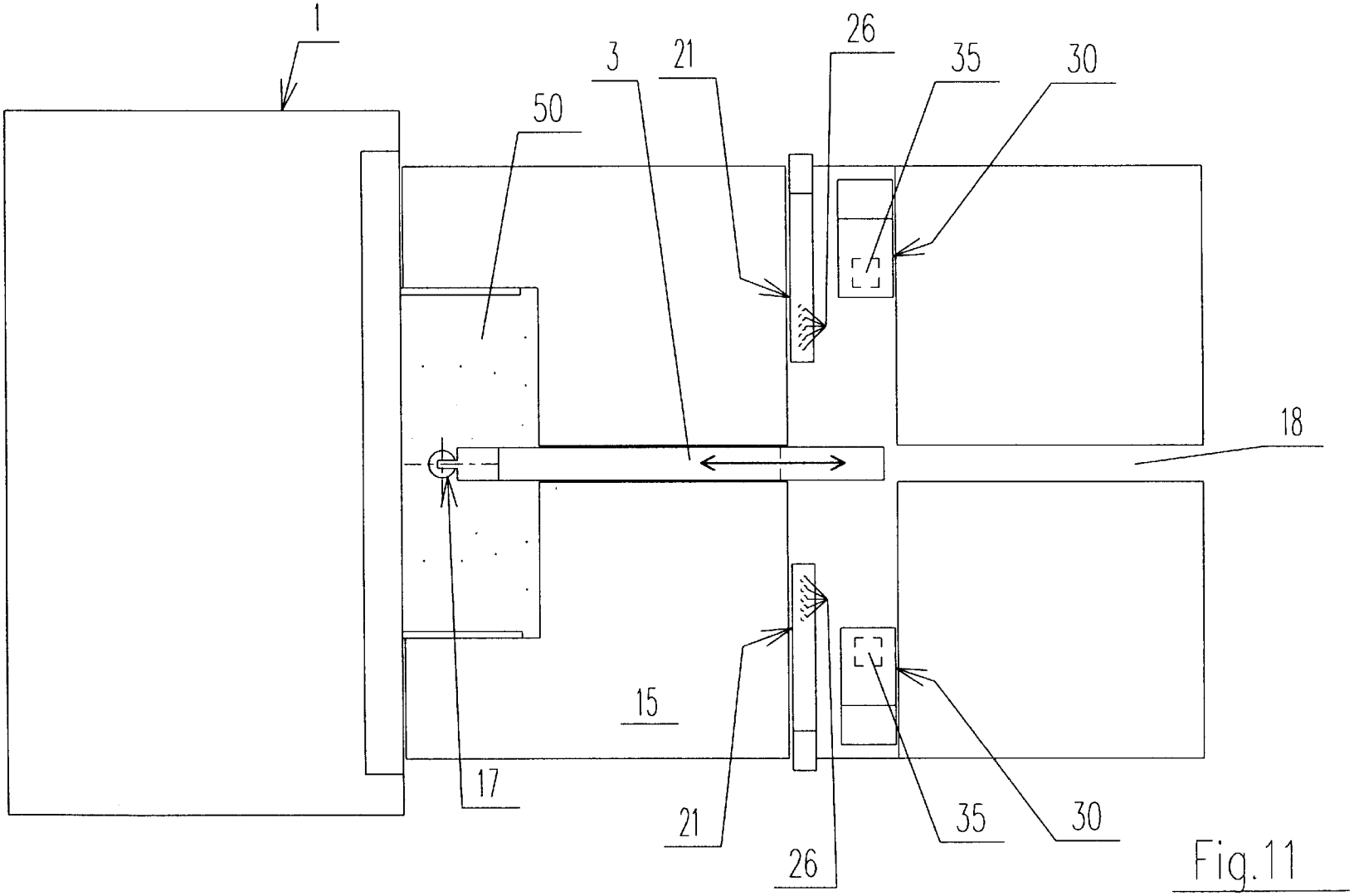

Once the second side of the sheet is bent, the manipulator moves back again in order to extract the sheet from the panelling machine, therefore it rotates by 90° and it moves forward again, in order to bring a third side of the sheet 50 inside the panelling machine, as shown in FIG. 11.

Figure 12:
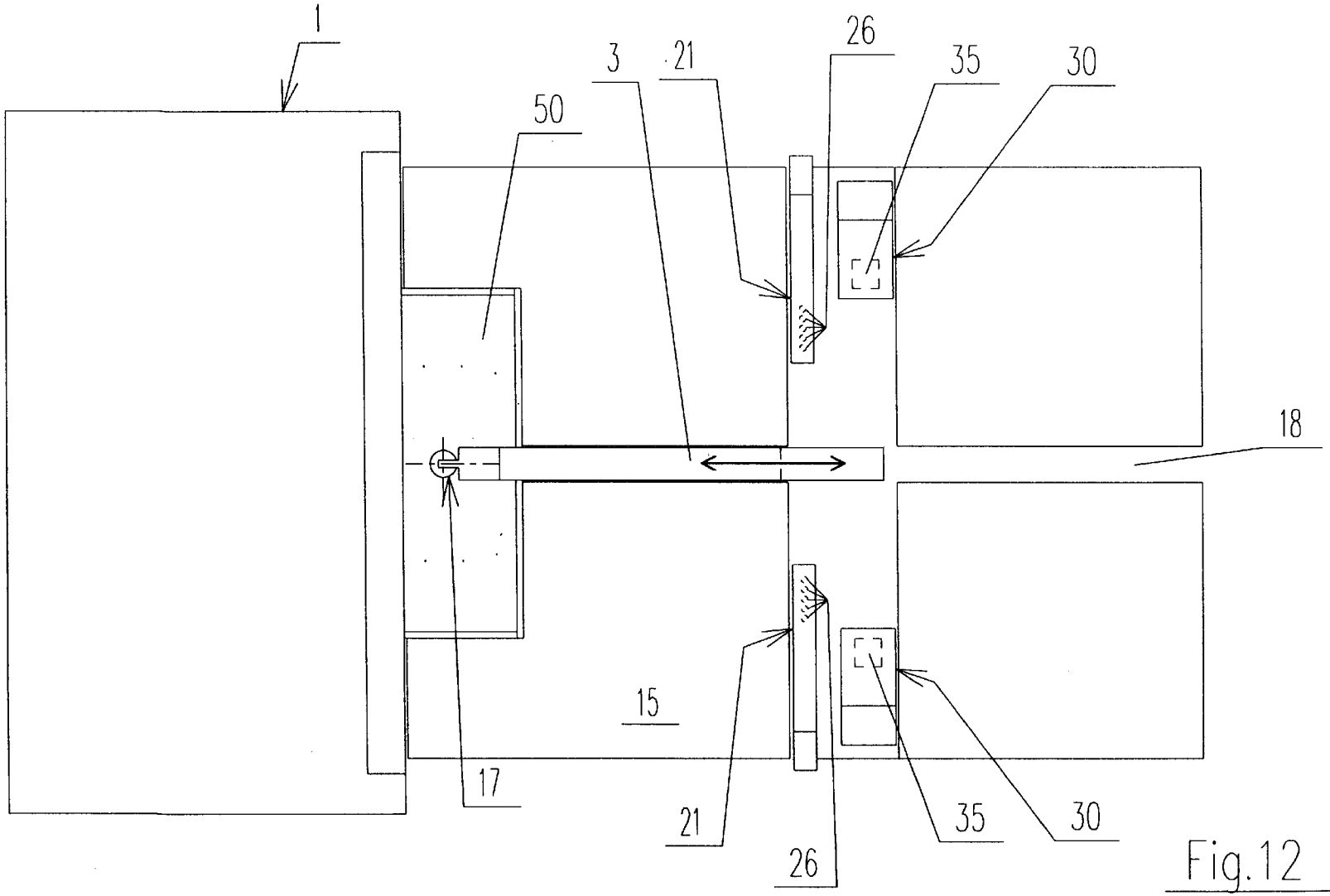
Figure 13:
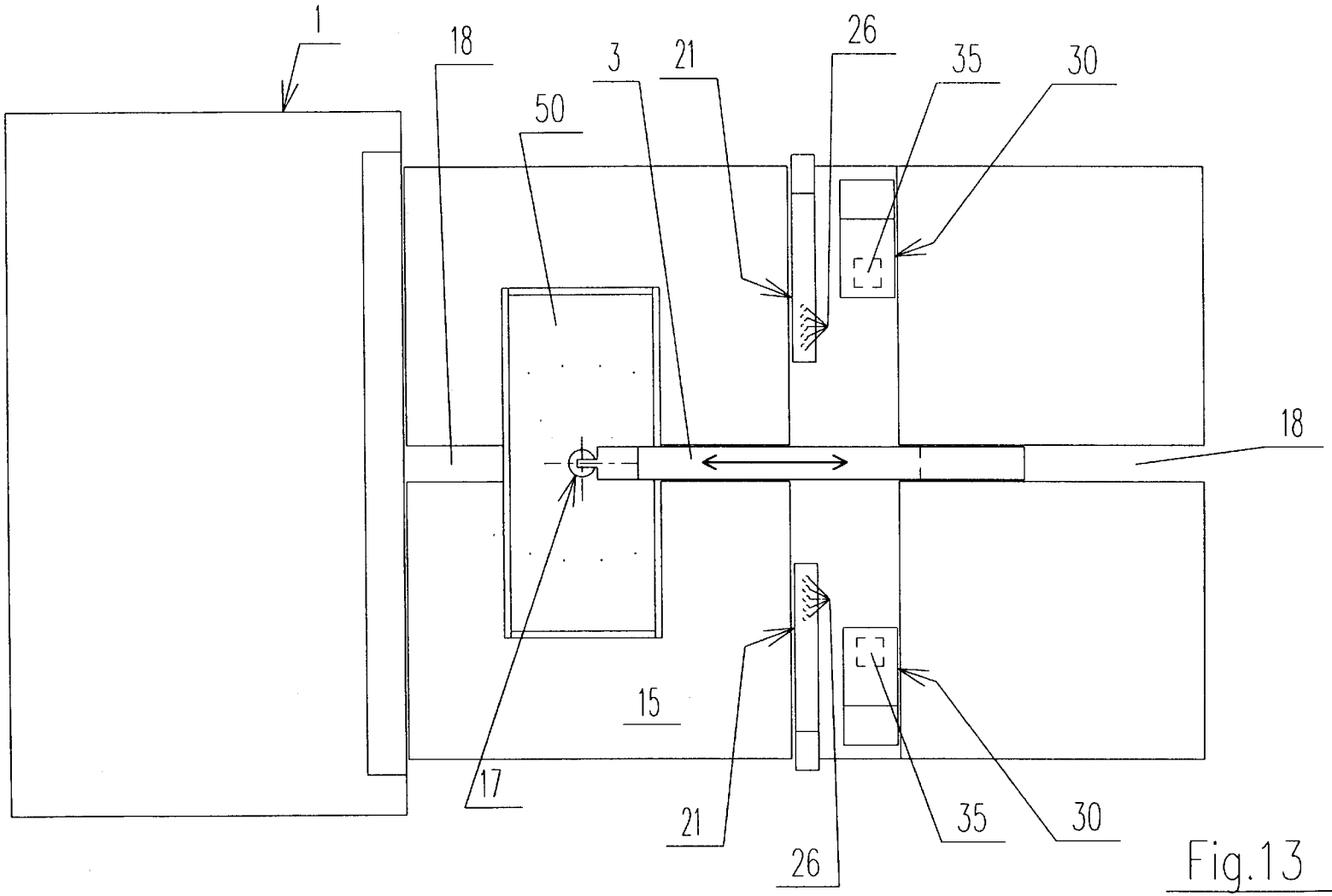

Therefore the operations are repeated, with a 180° rotation in order to bring a fourth and last side of the sheet 50 inside the panelling machine, as shown in FIG. 12.

Once the bending of the sides of the sheet is done, the manipulator-rotator carriage 3 moves back, the upper jaw 17 is lifted in order to release the finished metal sheet panel, that can be unloaded manually or preferably automatically.

It is clear that the one just being described is only an example of a possible machining cycle of a metal sheet that can be carried out by the machine according to the invention.

What is claimed is:

1. A machine for machining metal sheets, comprising:

a bending machine for bending sides of a metal sheet;

a manipulator-rotator that is mobile relative to the bending machine, wherein said manipulator-rotator automatically positions the metal sheet while the metal sheet is being bent;

wherein said machine comprises at least one punching press for punching said metal sheet that is served by said manipulator-rotator, so that said manipulator-rotator is utilized for automatic positioning of the metal sheet both during bending and during punching of the metal sheet, and wherein said at least one punching press comprises two punching presses, both served by said manipulator-rotator, and said two punching presses comprise a multi-punch press and a mono-punch press.

2. The machine according to claim 1, wherein said mono-punch press is utilized for shearing the corners of the metal sheet.

3. The machine according to claim 1, wherein said two punching presses each comprise at least one "C"-shaped supporting structure for punching tools that is transverse to a sliding direction of said manipulator-rotator, and has a throat facing toward said manipulator-rotator.

4. The machine according to claim 3, wherein said at least one "C"-shape supporting structure is mobile transversally to the sliding direction of the manipulator-rotator, in order to position the punching tools in relation to the metal sheet.

5. The machine according to claim 4, wherein said at least one "C"-shape supporting structure comprises two facing "C"-shaped supporting structures.

* * * * *

UNITED STATES PATENT AND TRADEMARK OFFICE

CERTIFICATE OF CORRECTION

PATENT NO. : 6,185,974 B1
DATED : February 13, 2001
INVENTOR(S) : Gianfranco Venturini It is certified that error appears in the above-identified patent and that said Letters Patent is hereby corrected as shown below:

Title page,
Item [73], The assignee has been omitted. Please add the following:
-- Salvagnini Italia S.p.A., Italy --.

In the Inventors address, please replace "Predicate" with -- Predicale --.

Column 1,
Line 11, replace the word "comers" with the word -- corners --.

Column 4,
Line 2, replace the word "comers" with the word -- corners --.
Line 12, replace the word "brine" with the word -- bring --.

Signed and Sealed this

Eighteenth Day of June, 2002

*Attest:*

*Attesting Officer*

JAMES E. ROGAN
*Director of the United States Patent and Trademark Office*